US009986773B2

(12) United States Patent
Kroecher

(10) Patent No.: US 9,986,773 B2
(45) Date of Patent: Jun. 5, 2018

(54) CONVERTIBLE PANTS

(71) Applicant: Ideavelopment Product Development & Consulting Inc., North Vancouver (CA)

(72) Inventor: Andre Kroecher, North Vancouver (CA)

(73) Assignee: Ideavelopment Product Development & Consulting Inc., North Vancouver (CA)

( * ) Notice: Subject to any disclaimer, the term of this patent is extended or adjusted under 35 U.S.C. 154(b) by 0 days. days.

(21) Appl. No.: 14/599,963

(22) Filed: Jan. 19, 2015

(65) Prior Publication Data

US 2016/0206022 A1 Jul. 21, 2016

(51) Int. Cl.

| | |
|---|---|
| ***A41D 15/00*** | (2006.01) |
| ***A41D 1/06*** | (2006.01) |
| ***A41D 27/10*** | (2006.01) |

(52) U.S. Cl.

CPC ..... *A41D 15/002* (2013.01); *A41D 1/06* (2013.01); *A41D 27/10* (2013.01)

(58) Field of Classification Search

CPC . A41D 1/06; A41D 1/08; A41D 15/00; A41D 15/002; A41D 15/02; A41D 15/04; A41D 13/0012; A41D 13/02; A41D 13/065; A41D 13/06; A41D 13/0575; A41D 13/0587; A41D 27/201; A63B 71/1225

USPC ... 2/228, 227, 238, 22, 23, 71, 72, 79, 78.4, 2/269, 247, 250, 252

See application file for complete search history.

(56) References Cited

U.S. PATENT DOCUMENTS

| | | | | |
|---|---|---|---|---|
| 1,581,570 | A | 4/1926 | Frankel | |
| 1,885,527 | A * | 11/1932 | Luft | A41D 17/00 2/227 |
| 2,262,564 | A * | 11/1941 | Strother | A41D 17/00 36/2 R |
| 2,519,202 | A | 8/1950 | Slater | |
| 4,006,495 | A | 2/1977 | Jones | |
| 4,104,742 | A | 8/1978 | Rahaim | |
| 4,190,908 | A | 3/1980 | Herskind | |
| D255,168 | S * | 6/1980 | Taylor | D2/742 |
| 4,215,435 | A | 8/1980 | Miele | |
| D261,323 | S * | 10/1981 | Catron | D2/742 |
| 4,301,546 | A * | 11/1981 | de Polo | A41D 1/06 2/227 |
| 4,766,613 | A * | 8/1988 | Wells | A41D 15/002 2/227 |

(Continued)

FOREIGN PATENT DOCUMENTS

| | | |
|---|---|---|
| DE | 2616547 A1 | 11/1977 |
| DE | 202004012222 U1 | 11/2004 |

(Continued)

*Primary Examiner* — Anna Kinsaul
*Assistant Examiner* — James Heracklis
(74) *Attorney, Agent, or Firm* — Oyen Wiggs Green & Mutala LLP

(57) ABSTRACT

A pair of convertible pants comprising an upper pants portion, a lower pants portion, an opening extending longitudinally from a hem end of the lower pants portion to a section that turns and continuously extending substantially circumferentially around the leg opening and ends at a terminus, and a closure being operable to extend along the entire length of the opening to selectively open and close the opening.

13 Claims, 6 Drawing Sheets

(56) References Cited

U.S. PATENT DOCUMENTS 5,008,962 A * 4/1991 Smith ..... A41D 1/06 2/227
5,033,126 A * 7/1991 Wruck ..... A41D 1/08 2/22
5,153,944 A 10/1992 Teel
5,191,659 A 3/1993 Backus
5,608,915 A * 3/1997 Libit ..... A41D 1/06 2/228
5,642,526 A * 7/1997 Thompson ..... A41D 13/02 2/69
5,669,078 A * 9/1997 Scremin ..... A41D 27/20 2/22
5,774,892 A * 7/1998 Tisdale ..... A41D 1/06 2/115
5,802,611 A * 9/1998 McKenzie ..... A41D 13/1236 2/114
5,822,802 A * 10/1998 Chou ..... A41D 13/1254 2/227
5,864,888 A * 2/1999 Archer ..... A41D 1/082 2/227
5,943,699 A * 8/1999 Barbeau ..... A41D 1/067 2/227
6,119,270 A * 9/2000 Chou ..... A41D 3/00 2/108
6,161,223 A 12/2000 Andrews
6,185,752 B1 * 2/2001 Hendersen ..... A41D 17/00 2/23
6,260,200 B1 * 7/2001 Alfred ..... A41D 13/1236 2/69
6,260,209 B1 * 7/2001 St. Ange ..... A41D 1/06 2/227
6,305,027 B2 * 10/2001 Chou ..... 2/227
6,336,226 B1 * 1/2002 Garcia ..... A41D 15/04 2/227
D457,290 S * 5/2002 Thompson ..... D2/743
6,654,968 B2 * 12/2003 Braun ..... A41D 1/06 2/269
6,978,484 B2 12/2005 Donlan et al.
7,404,213 B2 * 7/2008 Lieberman ..... A41D 13/012 2/2.15
D614,378 S * 4/2010 Viola ..... D2/742
7,694,349 B2 * 4/2010 Skottheim ..... A41D 13/015 2/212
D616,630 S * 6/2010 Christiansen ..... D2/742
7,814,574 B2 10/2010 Gheneva
D635,331 S 4/2011 Eckman et al.
7,937,767 B2 * 5/2011 Leach ..... A41B 11/12 2/22
7,966,672 B1 * 6/2011 Hagerman ..... A41D 13/02 2/227
7,981,135 B2 7/2011 Thorpe
D668,433 S 10/2012 Boyle
8,402,565 B1 3/2013 Penner
8,707,468 B2 * 4/2014 Reynolds ..... F41H 1/02 2/227
8,819,865 B1 9/2014 Crye
8,832,867 B2 * 9/2014 Boyle ..... 2/227
9,301,553 B1 * 4/2016 Donovan ..... A41D 1/00
9,572,381 B2 * 2/2017 Maryea ..... A41D 15/00
2001/0004771 A1 * 6/2001 Chou ..... A41D 1/007 2/227
2002/0040496 A1 4/2002 Blaire
2004/0040068 A1 3/2004 Silver
2005/0251896 A1 * 11/2005 Donlan ..... A41D 1/06 2/269
2006/0137075 A1 6/2006 Gheneva
2007/0214547 A1 * 9/2007 Mullen ..... A41D 1/06 2/227
2008/0010723 A1 * 1/2008 Bingham ..... A41D 1/08 2/227
2008/0032824 A1 * 2/2008 Roman ..... A41D 1/08 473/415
2008/0092273 A1 * 4/2008 Marshall ..... A41D 1/08 2/228
2009/0282600 A1 * 11/2009 Robinson ..... A41D 27/20 2/79
2009/0293171 A1 12/2009 Fayle et al.
2010/0170026 A1 * 7/2010 Jeffords ..... A41D 1/06 2/227
2010/0281601 A1 * 11/2010 Clarke ..... A41D 1/08 2/236
2011/0016603 A1 1/2011 Gheneva
2011/0067159 A1 * 3/2011 Smith ..... A41D 1/08 2/22
2012/0117713 A1 * 5/2012 Hoffner ..... A41D 27/20 2/227
2012/0304361 A1 * 12/2012 Jeffords ..... A41D 1/06 2/227
2013/0125287 A1 * 5/2013 Boyle ..... A41D 15/002 2/70
2013/0174315 A1 * 7/2013 Slank ..... A41D 27/28 2/69
2013/0254969 A1 * 10/2013 Getzen ..... A41D 27/00 2/108
2014/0007319 A1 * 1/2014 Kuhl ..... A41D 1/06 2/227
2014/0130237 A1 5/2014 Vanderburgh
2014/0196188 A1 7/2014 Brady
2016/0206022 A1 * 7/2016 Kroecher ..... A41D 15/002

FOREIGN PATENT DOCUMENTS

DE 102004014655 A1 10/2005
EP 2108272 A1 10/2009
EP 1778032 B1 10/2011
FR 1556067 A 1/1969
GB 2056845 A 5/1981
JP 09256206 A 9/1997
JP 2003201610 A 7/2003
JP 2010-531395 A 9/2010
JP 2010531395 A 9/2010
WO WO 03099049 A1 * 12/2003
WO 2006027477 A1 3/2006
WO 2007087532 A2 8/2007
WO 20090000009 A1 12/2008
WO 20090000010 A1 12/2008
WO 2014047157 A1 3/2014

* cited by examiner

CONVERTIBLE PANTS

FIELD

This invention relates to convertible garments, and more particularly to convertible pants which are adjustable in length, from a long configuration to a short configuration, and vice versa.

BACKGROUND

Some convertible pants include pant legs that can be completely removed. With the lower pant portions removed, the pants have short legs. While such convertible pants can easily be converted from pants to shorts, the conversion from shorts to pants can be time-consuming and inconvenient, because the wearer must align the ends of one or more attachment devices to fasten the two pieces of garments together. Moreover, once the lower pant portions are removed, there is often no convenient way to store and carry them. Also, a wearer may need to remove boots or other footwear to put on or take off the lower pant portions.

U.S. Pat. Application No. 2010/0281601 discloses a pair of convertible pants which comprises releasable seams that extend from the hem end of the leg to below knee length. Leg attachment devices are provided on a lower portion of each leg, and respective upper garment attachment devices are provided above an upper end of the releasable seams. The garment is converted from long pants to shorts by opening the releasable seams and folding a lower portion of each leg to extend beside an upper portion of the garment. The lower legs can be folded to be either on the outside or the inside of the garment. To convert the pants into shorts by folding the lower legs to be on the inside of the garment (or vice versa), the wearer must do so by removing the pants altogether, which can be undesirable. While the wearer may choose to convert the pants into shorts by folding the lower legs to be on the outside of the garment, some wearers may find this to be unattractive.

DE 102004014655 describes a pair of pants having pant legs that are adjustable in length. The pants comprise a zipper that runs circumferentially around the leg. When the zipper is fully open, the pants are in their long leg configuration. To convert from a long leg configuration to a short leg configuration, the wearer must align the ends of the zipper and a section of the pant leg will be folded and secured inside the pants. The shorter the short leg configuration, the longer the section of the pants that are to be folded and secured inside the pants. Accordingly, these pants can be undesirably uncomfortable if the short leg configuration is the length of a pair of conventional shorts.

Despite the variety of convertible pants available, there remains a need for attractive and comfortable convertible pants that can be converted from shorts to long pants quickly and easily, preferably by using only one hand.

SUMMARY

One aspect of the invention provides a convertible pant leg having a slit opening that may be closed or opened. When the slit opening is closed a lower part of the pant leg has a tubular configuration. When the slit opening is opened the lower portion of the pant leg has the form of a sheet of material that may be folded or rolled for storage. The sheet of material may remain attached to an upper part of the pant leg, for example, by a thin strip of material. A storage compartment may be provided to hold the folded or rolled lower part of the pant leg. The slit opening may have a circumferentially extending portion that extends around the pant leg at a level corresponding to a desired length of a short configuration of the pant leg. The slit opening turns and extends from the circumferentially extending portion to a hem at a lower end of the pant leg. A fastener, for example a continuous zipper, may be provided to selectively open and close the slit opening. The fastener may have a closed end at the end of the slit opening furthest from the hem. At the closed end, the sides of the fastener are not separable in normal use.

One aspect of the invention provides a pair of convertible pants comprising an upper pants portion having a waist opening and a leg opening, a lower pants portion attached to the upper pants portion, an opening extending longitudinally from a hem end of the lower pants portion to a section that turns and continuously extending substantially circumferentially around the leg opening and ending at a terminus, and a closure, having a handle, being operable to extend along the entire length of the opening to selectively open and close the opening.

Another aspect of the invention provides a pair of convertible pants comprising an upper pants portion having a waist opening and a leg opening, a lower pants portion attached to the upper pants portion, a first opening extending longitudinally from a hem end of the lower pants portion to a first point, a second opening extending substantially circumferentially around the leg opening from a second point and terminating at a terminus, a closure, having a handle, operable to selectively open and close the opening, a flap having one end securely attached to one of the lower or upper pants portion, and a free end releasably connectable to the other lower or upper pants portion for connecting the lower pants portion to the upper pants portion when the first and second openings are substantially open, and a stowage compartment attached to the upper pants portion for receiving and storing the lower pants portion.

Another aspect of the invention provides a method for converting pants from a long configuration to a short configuration.

Further features and aspects of the invention are described below and/or shown in the drawings.

BRIEF DESCRIPTION OF THE DRAWINGS

The accompanying drawings illustrate non-limiting example embodiments of the invention.

DETAILED DESCRIPTION OF EXAMPLE EMBODIMENTS

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

The invention relates to convertible pants. Such pants can be quickly and easily converted from shorts to long pants, and vice versa.

Figure 1:
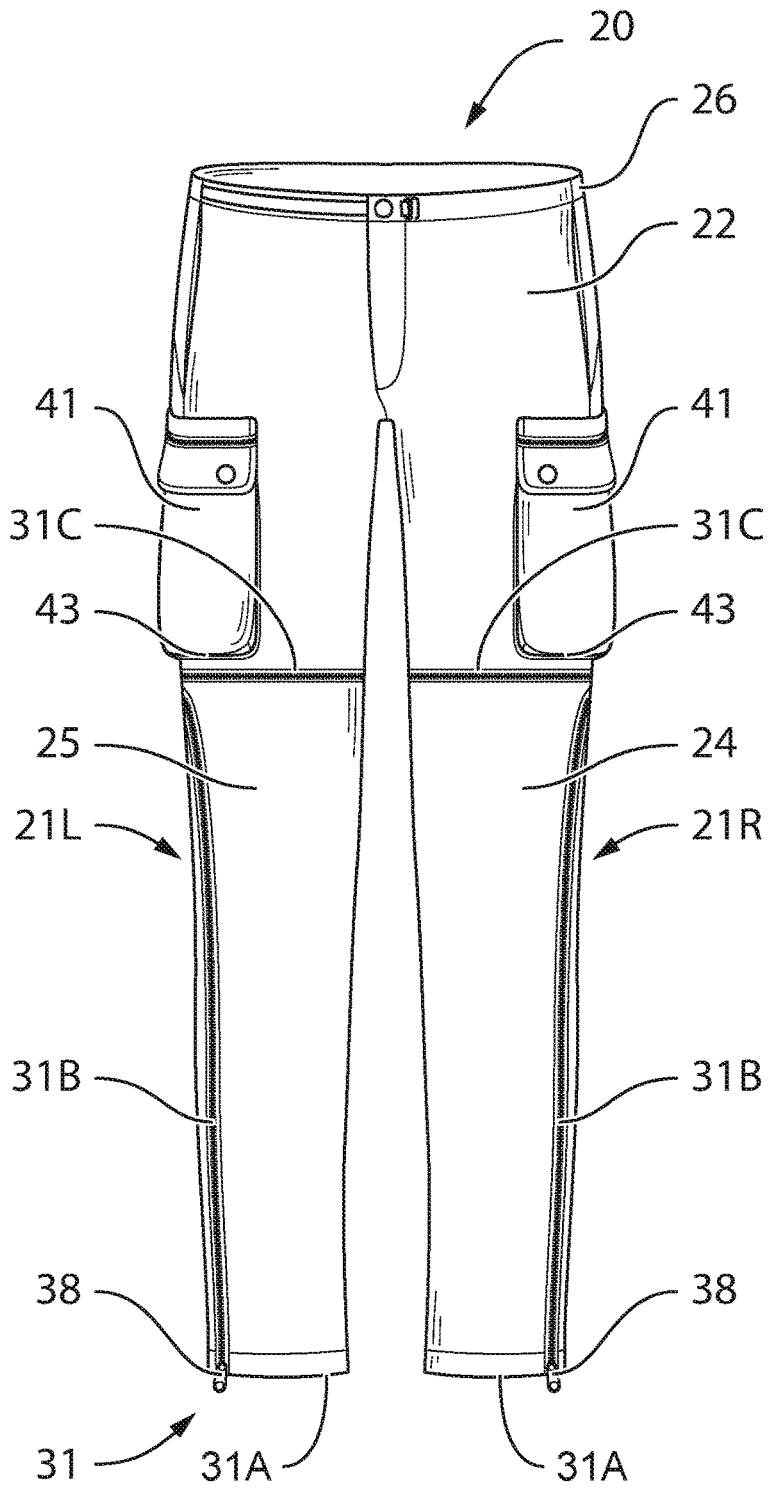
FIG. 1 is a front view of a pair of convertible pants according to an example embodiment of the invention.
Figures 2A, 2B, 2C:
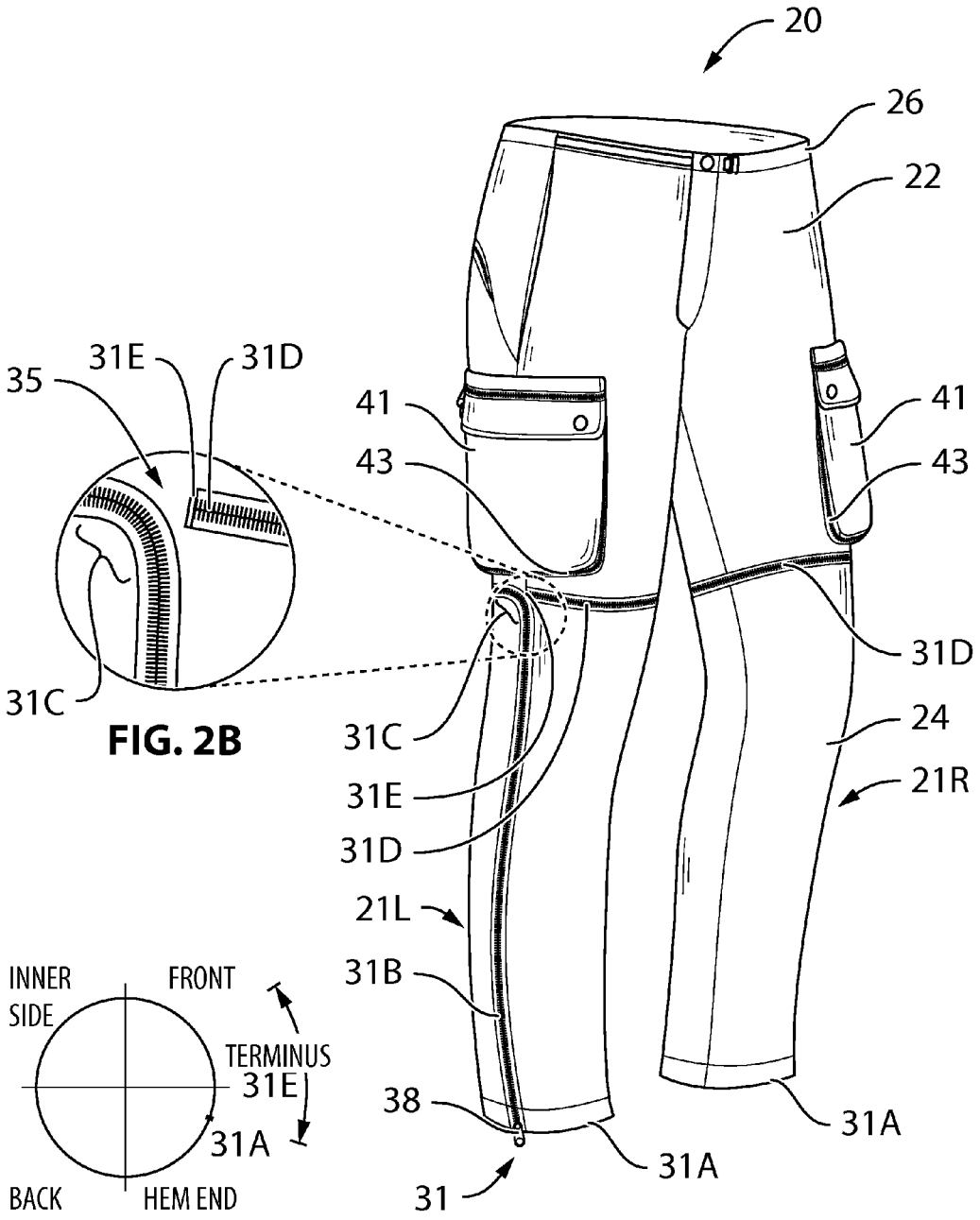
FIG. 2A is a side view of a pair of convertible pants according to an example embodiment of the invention showing openings on each leg in their closed configurations.
FIG. 2B is an enlarged partial view of the area indicated by the circle in FIG. 2A.
FIG. 2C is a schematic cross section view of a lower pants portion looking downward.
Figure 3:
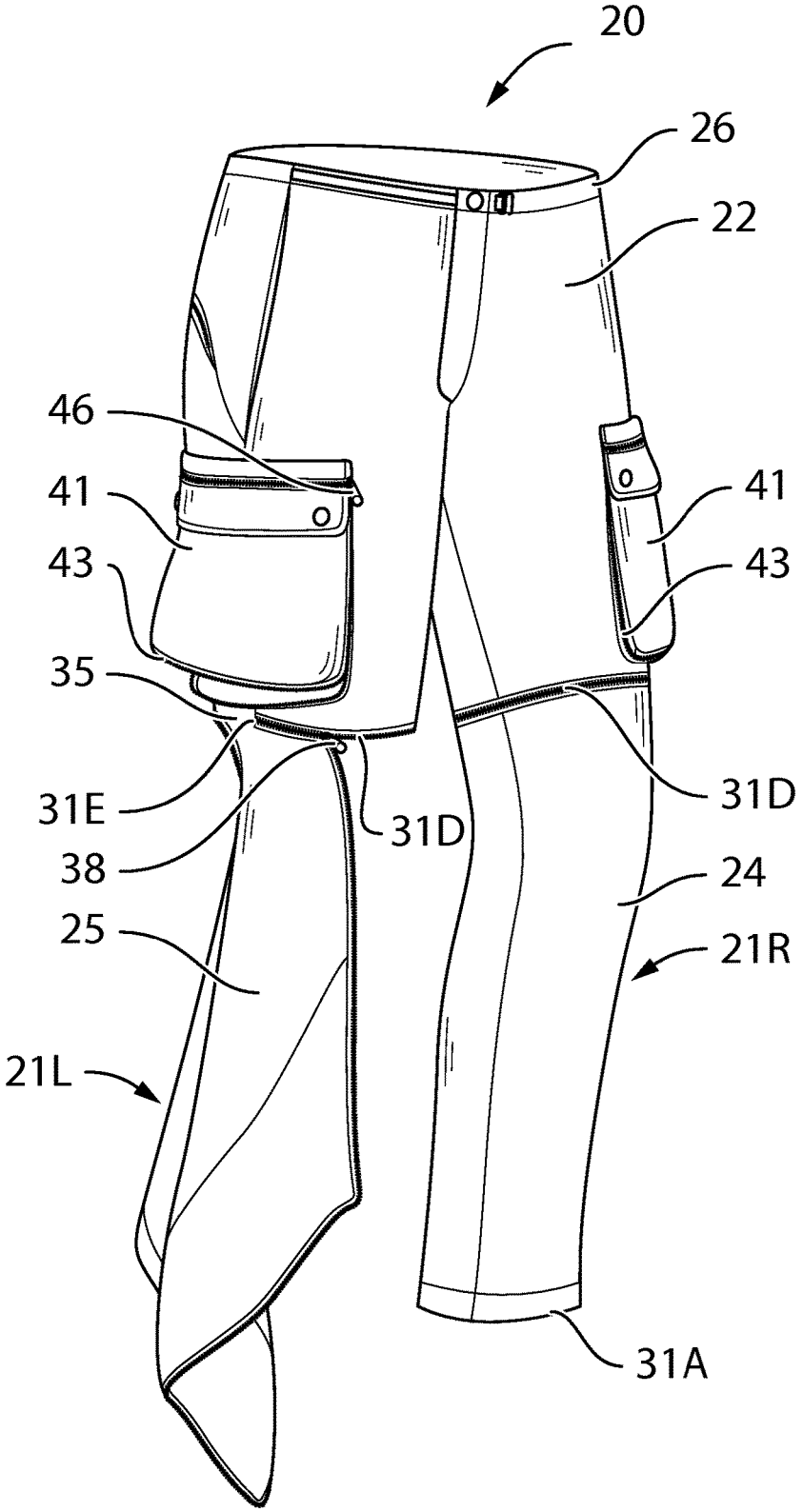
FIG. 3 is a side view of a pair of convertible pants according to an example embodiment of the invention showing the opening in one lower pants portion open.
Figure 5:
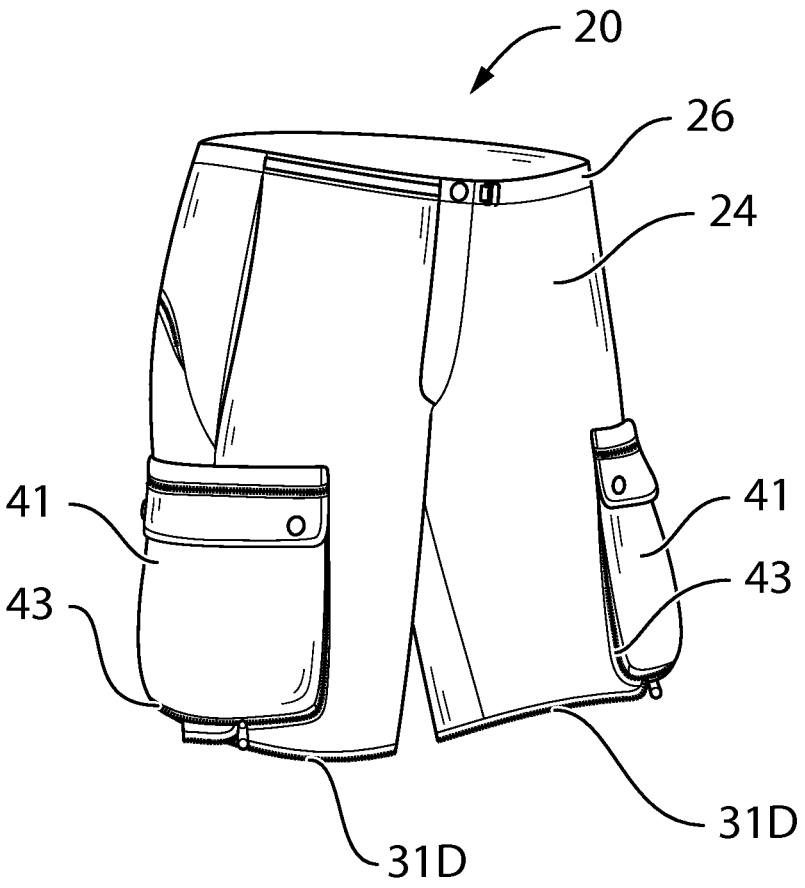
FIG. 5 is a side view of a pair of convertible pants according to an example embodiment of the invention showing the lower pant portions received and stored in pockets, leaving the upper pants portion wearable as shorts.

FIGS. 1 and 2 show, respectively, front and side views of a pair of convertible pants 20 according to an example embodiment of the invention. Pants 20 include upper pants portion 22 and legs 21R and 21L which respectively include lower pant portions 24 and 25. Upper pants portion 22 comprises a waist opening 26 and two leg openings. Lower pant portions 24 and 25 are mirror images of one another, so only one will be described. FIG. 3 shows lower pants portion 25 comprising opening 31. A connection 35 connects lower pants portion 25 to upper pants portion 22 when opening 31 is fully open. FIG. 5 shows a side view of pants 20 as shown in FIG. 2 with lower pants portion 25 stowed within stowage compartment 41.

Opening 31 extends from hem end 31A to terminus 31E. Opening 31 comprises a longitudinal section 31B that extends from hem end 31A to curved section 31C. In curved section 31C, opening 31 turns to join a circumferential section 31D that continues to run substantially circumferentially around the leg opening until it reaches terminus 31E (FIG. 2).

In the illustrated embodiment, longitudinal section 31B extends along the outer lateral side of lower pants portion 25. Longitudinal section 31B may follow a line that is straight or somewhat curved. Longitudinal section 31B may extend parallel to legs 21R, 21L (i.e. extend vertically but this is not mandatory).

Circumferential section 31D is positioned at a distance along leg 21 that defines the lower end of pants 20 when in their short configuration. For example, the upper end of curved section 31C may be positioned approximately mid-length of convertible pants 20 so that when pants 20 are in their short configuration, the shorts extend to about thigh-length as shown. The shorts may be any other suitable length, including, but not limited to calf length and knee length. Circumferential section 31D preferably follows a desired hem-line for the pants when in a short configuration. In some embodiments, circumferential section 31D extends at least generally horizontally around a leg 21.

Curved section 31C preferably comprises a radius of curvature of not less than about 1 centimeter to allow smooth operation of a closure as described below. In some embodiments, curved section 31C has a radius of curvature in the range of from about 1 to about 12 centimeters (FIG. 2B). Curved section 31C turns through an angle of approximately 90 degrees (90±5 degrees in some embodiments).

In the illustrated embodiment, terminus 31E is positioned adjacent to curved section 31C. Terminus 31E may be at a dead end of circumferential section 31D. Preferably, terminus 31E and the top side of curved section 31C are at the same elevation (i.e. when leg 21 is vertical the top of curved section 31C and terminus 31E both lie generally in the same horizontal plane). This is not mandatory, however. In alternative embodiments, terminus 31E can be positioned below curved section 31C, proximate to longitudinal section 31B. Terminus 31E can also be positioned above curved section 31C.

In the illustrated embodiment, terminus 31E is spaced apart from curved section 31C by a small distance (e.g. a distance of about 10 cm or less. In some embodiments, terminus 31E is spaced apart from the closest part of curved section 31C by a distance in the range of about ⅓ cm to 2½ cm. For example, terminus 31E may be spaced apart from the closest part of curved section 31C by a strip of material having a width of 1 or 1½ cm in some embodiments.

In the illustrated embodiment, terminus 31E is located to one side of a longitudinal line extending vertically along the leg 21R or 21L from hem end 31A. This longitudinal line defines the circumferential position of hem end 31A. The circumferential distance between terminus 31E and the circumferential position of hem end 31A may be, for example, in the range of about 1 centimeter to about 5 centimeters in some embodiments.

In some embodiments, terminus 31E is located at the other side of hem end 31A such that terminus 31E is closer to the front side of lower pants portion 25 relative to hem end 31A. In such embodiments, the circumferential distance between terminus 31E and hem end 31A may be, for example, in the range of about 1 centimeter to about 15 centimeters (see e.g. FIG. 2C).

In the illustrated embodiment, connection 35 is defined between curved section 31C and terminus 31E (FIG. 3). Connection 35 can also be positioned between longitudinal section 31B and terminus 31E. The width of connection 35 is most typically in the range of from about 1% to about 50% of the width of the leg opening. As described herein, some embodiments provide narrow connections and this facilitates storage of lower pants portion 25 while the pants are in a short configuration. For example, the width of connection 35 is approximately 1 centimeter (e.g. 1 cm±½ cm) in some embodiments. In some embodiments, lower pants portion 25 and upper pants portion 22 and connection 35 are all formed of the same piece of material.

Pants 20 further comprise a closure 38 for selectively opening and closing opening 31. In the illustrated embodiment, closure 38 runs continuously along the entire length of opening 31, from hem end 31A to terminus 31E. In the illustrated embodiment, terminus 31E is positioned at an outer side of convertible pants 20 so that when opening 31 is fully open, handle 39 is positioned at the outer side of pants 20.

Various types of closure may be provided. In some embodiments, closure 38 comprises a linear slide fastener. In such embodiments, closure 38 may comprise a handle 39 for operating closure 38. Handle 39 may comprise a tab, cord, or other graspable member. The linear slide fastener may comprise two parallel tracks that can be interlocked or separated by the pulling of a slider between them. Linear slide fasteners may, for example, comprise plastic zippers, metal zippers, coil zippers, invisible zippers, PVC tape zippers, or the like.

The linear slide fastener can be a closed-end zipper. The closed end can be at terminus 31E. The sides of a closed-end zipper do not separate at terminus 31E and accordingly, the wearer can quickly and easily open or close opening 31 without needing to align the ends.

The tracks of the linear slide fastener may optionally be covered by a flap of fabric on the inside surface of pants 20 to prevent the fastener from coming in contact with the wearer's legs. The tracks of the linear slide fastener may be concealed on the outside surface of pants 20 by flaps or the like to create an aesthetically pleasing appearance.

In some embodiments, pants 20 comprise stowage compartment 41 for storing lower pants portion 25. Stowage compartment 41 can be in the form of a pocket or pouch, for example. The pocket or pouch may be of any suitable shape or configuration, including, but not limited to cylindrical, circular, square, rectangular, ovoid, or irregularly-shaped. The pocket or pouch may also be of any suitable size.

Stowage compartment 41 comprises opening 43. Opening 43 is located close to connection 35. Opening 43 can be in the lower part of stowage compartment 41. In some embodiments, opening 43 can extend along a lower edge of stowage compartment 41. With opening 31 fully opened, lower pants portion 25 hangs from upper pants portion 22 by connector 35. A wearer may insert lower pants portion 25 into stowage compartment 41. With lower pants portion 25 fully inserted into stowage compartment 41 connector 35 may fold along the lower edge of the now-shortened pants and extend into stowage compartment 41 through opening 43.

Figure 4:
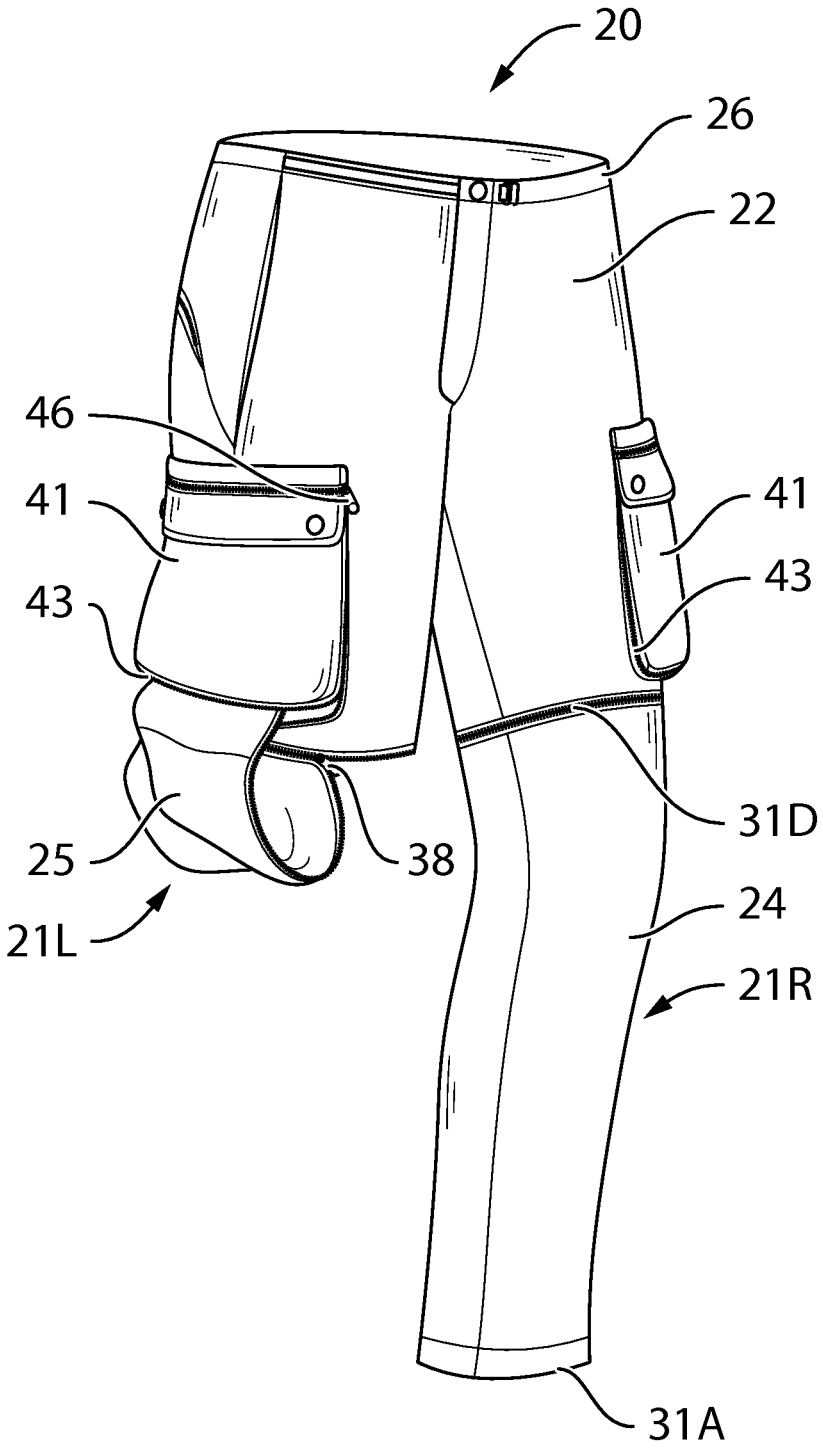
FIG. 4 is a side view of a pair of convertible pants according to an example embodiment of the invention showing the opening in one lower pants portion fully released and the lower pants portion partially folded and stored in the pocket.

Opening 43 can be wider than connection 35 such that when the bulk of lower pants portion 25 is stowed in compartment 41, connection 35 can conveniently extend through opening 43. As illustrated in FIG. 4, opening 43 may comprise a closure 46 for selectively closing opening 43 when lower pants portion 25 is stowed within stowage compartment 41 (and when the pants are in their long configuration). For example, opening 43 may be opened and closed by zippers or by other types of attachment devices, for example, hooks, buttons, snaps, Velcro™, or the like. The closure of opening 43 leaves a passage through which connection 35 can extend when lower pants portion 25 is stowed.

In the illustrated embodiment, stowage compartment 41 comprises a cargo pocket positioned on upper pants portion 22. Stowage compartment 41 can extend to slightly overhang lower pants portion 25. In such embodiments the lower edge of stowage compartment 41 may conceal connection 35 and/or portions of circumferential section 31D when the pants are in their shortened configuration.

Connection 35 may optionally comprise an attachment device such as buttons, snaps, Velcro™ and the like. Such attachment device may engage with a corresponding mating attachment device that can be located inside stowage compartment 41 to help to secure connection 35 inside stowage compartment 41 when lower pants portion 25 is stored within compartment 41. Such an attachment device may provide added security to inhibit lower pants portion 25 from slipping downward out of stowage compartment 41.

To convert pants 20 from a long configuration to a short configuration, the wearer can release opening 31 by operating closure 38. Where a linear slide fastener is used the opening may start from hem end 31A and end at terminus 31E. Once opening 31 is fully open, lower pants portion 25 can hang down from upper pants portion 22 via connection 35. Lower pants portion 25 can be subsequently folded or rolled up and stowed in stowage compartment 41. Lower pants portion 25 may comprise a predetermined pattern of fold lines defining lines along which lower pants portion 25 may easily be folded. In some embodiments a fold line is also defined across connection 35 in line with circumferential section 31D. Fold lines may be provided, for example, by pre-creasing the material of lower pants portion 25, stiffening the material on one or both sides of a fold line (e.g. by attaching a strip of bias tape), providing seams arranged to define fold lines, etc. In some embodiments a plurality of fold lines are defined on lower pants portion 25. The plurality of fold lines may intersect with one another to facilitate folding lower pants portion 25 into a compact flattened package.

To convert pants 20 from a short configuration to a long configuration, lower pants portion 25 can be unfolded or unrolled, and the wearer can close opening 31 by operating closure 38, starting from terminus 31E and terminating at hem end 31A.

The conversion of pants 20 from a short configuration to a long configuration can be performed with one hand. On closing opening 31, the wearer pulls handle 39 along opening 31 in a direction that is generally away from the waist. This allows the wearer to use one hand to keep the opening under tension, enabling closure 38 to align and close opening 31. One-handed operation of convertible pants has many benefits, especially when the wearer is engaged in outdoor activities such as skiing, climbing, snowboarding, biking, mountaineering, travelling, and hiking. For example, a wearer may be able to convert pants 20 between long and short configurations with one hand while hanging in a climbing harness. A skier may also be able to convert pants 20 between long and short configurations with one hand without needing to remove either skis or ski boots.

Figures 6A, 6B:
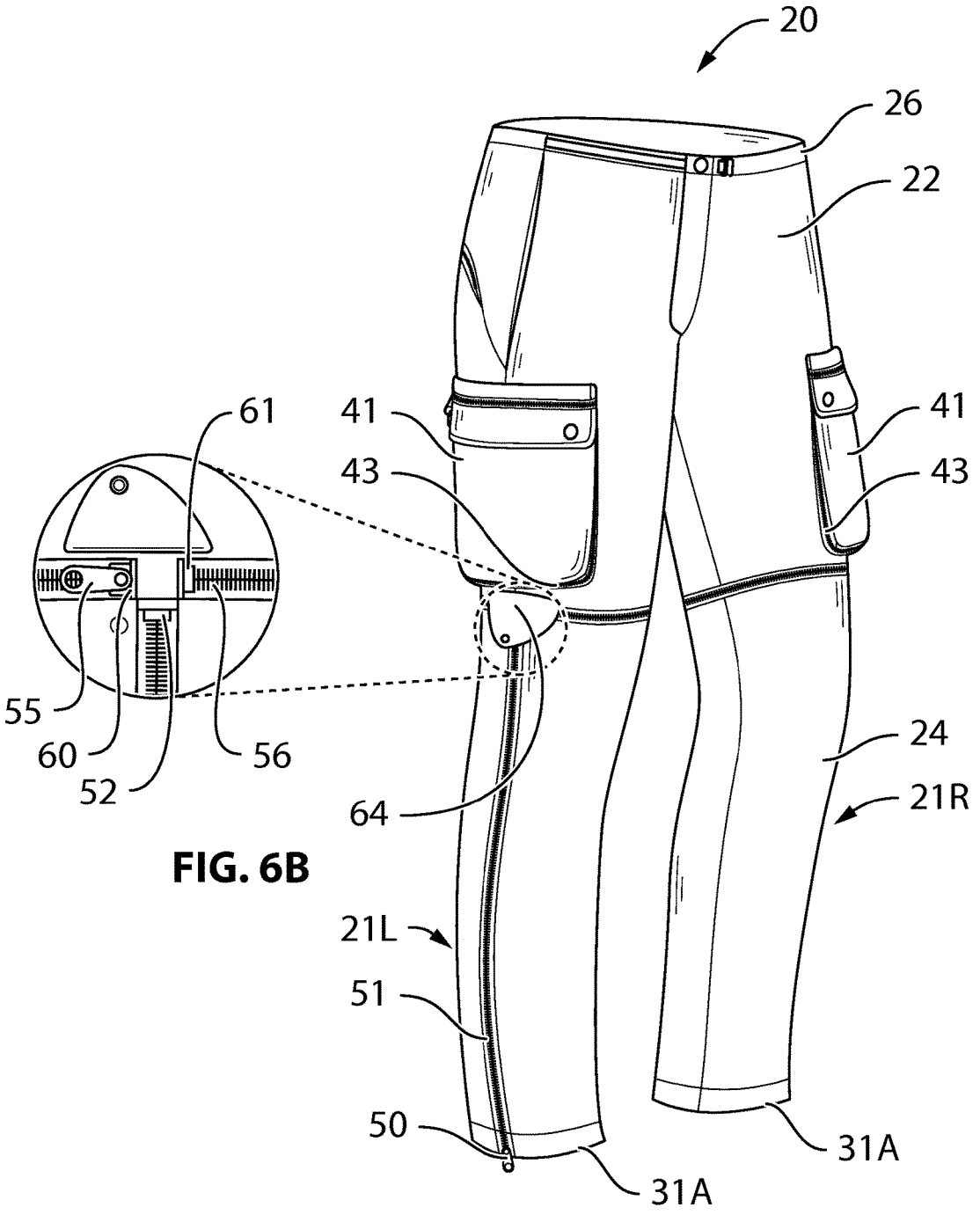
FIG. 6A is a side view of a pair of convertible pants according to another embodiment of the invention.
FIG. 6B is an enlarged partial view of the area indicated by the circle in FIG. 6A, with the flap open.

In some embodiments, convertible pants 20 comprise at least one closure arranged to close opening 31. In some embodiments, convertible pants 20 comprise two closures (FIGS. 6A and 6B). For example, a first closure 50 may be operable to open and close first opening 51, extending from hem end 31A to first point 52, and a second closure 55 may be operable to open and close second opening 56, extending circumferentially around the leg opening from second point 60 and terminating at terminus 61.

In some embodiments, first 50 and second 55 closures comprise linear slide fasteners. In some embodiments, at least one linear slide fastener is an open-end fastener such as an open-ended zipper so that the ends of the zipper are separable to permit detaching lower pants portion 25 from upper pants portion 22.

In the example embodiment illustrated in FIG. 2, lower pants portion 25 is integrally connected to upper pants portion 22 by connection 35. In the alternative, lower pants portion 25 can be releasably connected to upper pants portion 22. For example, as shown in FIGS. 6A and 6B, convertible pants 20 can comprise a flap 64. Flap 64 can be attachable to lower 25 or upper 22 pants portion by a detachable coupling like snaps, buttons, hook, Velcro™ or the like.

When flap 64 is attached to lower pants portion 25 or upper pants portion 22, second closure 55 extends along second opening 56, running substantially circumferentially around the leg opening and stopping at a mark proximate or adjoining one side of flap 64. Accordingly, flap 64 blocks second closure 55 from fully releasing second opening 56 and thereby allows lower pants portion 25 to remain attached to upper pants portion 22. Lower pants portion 25 can then be folded or rolled up and stowed within stowage compartment 41 such as a pocket or pouch that is attached to upper pants portion 22 as described above.

When flap 64 is released from lower 25 or upper 22 pants portion, second closure 55 extends the entire length of second opening 56, running circumferentially around the leg opening from second point 60 and terminates at terminus 61. In such embodiment, second opening 56 can be fully released. When first 51 and second 56 openings are fully released, lower pants portion 25 can be removably detached from upper pants portion 22. The detached lower pants portion 25 can subsequently be folded or rolled up and stowed within stowage compartment 41 such as a pocket or pouch that is attached to upper pants portion 22. Alternatively, the detached lower pants portion 25 can be completely removed from pants 20 so that the wearer need not carry the extra weight of lower pants portion 25.

In some embodiments, convertible pants 20 comprise two garment layers, an outer layer and an inner layer at least in lower parts of the legs. For example, lower pants portion 25 may be part of an outer layer that can be made from a waterproof material or other suitable materials. When opening 31 is fully open, lower pants portion 25 can be stowed within stowage compartment 41. Accordingly, pants 20 can remain in a long leg configuration with the inner layer exposed. In another embodiment, the inner layer may also comprise an opening similar to opening 31, which allows the inner layer to also be folded or rolled up and thus converts pants 20 to a short leg configuration. A second stowage compartment may be positioned proximate to stowage compartment 41 to receive and store the inner layer. The circumferential positions of the openings on the inner and outer layers may be offset relative to one another such that connections to the lower portions of the inner and outer layers are circumferentially aligned with the corresponding stowage compartment.

In the illustrated embodiment, convertible pants 20 are full-length pants when they are in their long configurations. This is not mandatory, however. Pants 20 can be any other suitable length, including, but not limited to crop or capris length and ankle length.

Convertible pants 20 may be manufactured from any material known in the art, including, but not limited to Gore-Tex™, nylon, polyester, Lycra™, Spandex™ polyester/cotton and denim. In some embodiments, lower 25 and upper 22 pant portions are manufactured from different materials.

Structures and methods as described herein may also be used to provide garment sleeves that are adjustable in length.

While the above description contains many specifications, these should not be construed as limitations on the scope of the invention, but as examples of various embodiments thereof. Many other ramifications and variations are possible within the teachings of the various embodiments.

Thus the scope should be determined by the appended claims and their legal equivalents, and not by the examples given.

INTERPRETATION OF TERMS

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a component (e.g. a member, closure, flap, pocket, assembly, device, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

The invention claimed is:

1. A pair of convertible pants comprising:

an upper pants portion having a waist opening and a pair of leg openings opposite to the waist opening, the upper pants portion formed to provide a pair of shorts having first and second legs;

a pair of lower pants portions respectively attached to the first and second legs;

the pair of convertible pants having a first configuration and a second configuration, wherein, in the first configuration, the pair of lower pants portions, when attached to the first and second legs, form a long pant and wherein, in the second configuration, the pair of lower pants portions are folded out of the way, while remaining attached to the corresponding one of the first and second legs, to form a shorts configuration, each lower pants portion comprising an upper edge and a hem end opposite to the upper edge;

each of the lower pants portions defining a corresponding slit opening extending from a closed end of the slit opening to the hem end, the closed end located between the upper pants portion and the lower pants portion immediately adjacent to a connection comprising a strip of material non-removably attaching the upper pants portion and the lower pants portion and longitudinally intermediate between the waist opening and the hem end of the lower pants portion, the slit opening comprising a circumferential section that extends from the closed end substantially circumferentially around the leg opening, the circumferential section merging into a first end of a curved section that curves to turn through an angle of approximately 90 degrees, such that a second end of the curved section extends towards the hem end, the second end of the curved section merging into a longitudinal section that extends to an open end of the slit opening at the hem end of the lower pants portion wherein the circumferential section, the curved section, and the longitudinal section are arranged in sequence to form the slit opening and the strip of material is between the closed end and the curved section; and a closure associated with each of the slit openings, the closure operable to selectively open and close the slit opening along its length, the closure comprising a linear slide fastener comprising a slider movable along the length of the slit opening, wherein, for any position of the slider along the slit opening the portion of the slit opening between the slider and the hem end is open and the portion of the slit opening between the slider and the closed end of the slit opening is closed.

2. A pair of convertible pants according to claim 1, wherein, the closure comprises a handle on the slider and the closed end of the slit opening is positioned at an outer side of the pants so that when the slider is positioned at the closed end of the slit opening so that the slit opening is fully open, the handle of the closure is positioned at the outer side of the pants.

3. A pair of convertible pants according to claim 2 further comprising a stowage compartment, attached to the upper pants portion proximate to the connection, for receiving and storing a corresponding one of the lower pants portions when the lower pants portion is in the second configuration.

4. A pair of convertible pants according to claim 1, wherein, the width of the connection is in the range of ½ cm to 1½ cm.

5. A pair of convertible pants according to claim 1, wherein, the curved section comprises a curve having a radius of curvature of not less than about 1 centimeter.

6. A pair of convertible pants according to claim 3, wherein, the stowage compartment comprises a selectively closable opening at a bottom edge thereof, wherein the bottom edge faces the hem end.

7. A pair of convertible pants according to claim 6, wherein, a width of the selectively closable opening is greater than the width of the connection.

8. A pair of convertible pants according to claim 7 further comprising an attachment device attached to the selectively closable opening, the attachment device being operable to selectively open and close the selectively closable opening for storing the lower pants portion.

9. A pair of convertible pants according to claim 8, wherein, the stowage compartment comprises a pocket.

10. A pair of convertible pants according to claim 9, wherein, the pocket is attached to an outside surface of the upper pants portion.

11. A pair of convertible pants according to claim 1, wherein the closed end of the slit opening is below a crotch of the pair of convertible pants.

12. A pair of convertible pants according to claim 11, wherein, when one of the lower pants portions is in the first configuration, the closed end of the corresponding slit is located above a knee portion of the leg extended by the lower pants portion.

13. A pair of convertible pants according to claim 12, wherein the circumferential section extends horizontally around the corresponding leg.

* * * * *